US006188853B1

(12) United States Patent
Ishida et al.

(10) Patent No.: US 6,188,853 B1
(45) Date of Patent: Feb. 13, 2001

(54) DOUBLE SIDE PRINTING APPARATUS

(75) Inventors: Shigeo Ishida, Kawasaki; Kiyoshi Chinzei, Kato-gun, both of (JP)

(73) Assignee: Fujitsu Limited, Kawasaki (JP)

( * ) Notice: Under 35 U.S.C. 154(b), the term of this patent shall be extended for 0 days.

(21) Appl. No.: 09/330,084

(22) Filed: Jun. 11, 1999

(30) Foreign Application Priority Data

Nov. 16, 1998 (JP) ..... 10-324795

(51) Int. Cl.[7] ..... G03G 15/00

(52) U.S. Cl. ..... 399/38; 399/306; 399/364; 399/384

(58) Field of Search ..... 399/384, 306, 399/364, 317, 335, 336, 16, 38; 101/229, 230, 231

(56) References Cited

U.S. PATENT DOCUMENTS

| | | | | |
|---|---|---|---|---|
| 3,694,073 | * | 9/1972 | Bhagat | 430/54 |
| 3,775,102 | * | 11/1973 | Punnett | 399/364 X |
| 4,958,187 | * | 9/1990 | Tsuchiya et al. | 399/306 |
| 5,150,167 | * | 9/1992 | Gonda et al. | 399/16 |
| 5,461,470 | | 10/1995 | De Cock et al. | 399/228 |
| 5,548,375 | * | 8/1996 | Mitsuya et al. | 399/38 X |
| 5,659,871 | * | 8/1997 | Fujimoto et al. | 399/384 |
| 5,765,081 | * | 6/1998 | Bogaert et al. | 399/306 X |
| 5,835,836 | | 11/1998 | Hirao | 399/336 |
| 5,848,323 | * | 12/1998 | Umeda et al. | 399/306 X |
| 5,887,236 | | 3/1999 | Hirao et al. | 399/330 |
| 5,905,930 | * | 5/1999 | Toyama et al. | 399/384 X |

FOREIGN PATENT DOCUMENTS

| | | |
|---|---|---|
| 7-181757 | 7/1995 | (JP) . |
| 8-211664 | 8/1996 | (JP) . |

OTHER PUBLICATIONS

U.S. Application Serial No.: 09/340,597.

* cited by examiner

*Primary Examiner*—Sophia S. Chen
(74) *Attorney, Agent, or Firm*—Armstrong, Westerman, Hattori, McLeland & Naughton

(57) ABSTRACT

A perfecting apparatus for executing prints on double surfaces of a recording medium is capable of minimizing a blank space on the recording medium. The perfecting apparatus has a first image forming unit, disposed downstream in a carrying direction of the recording medium, for forming a toner image on one surface of the recording medium, a second image forming unit, disposed upstream in the carrying direction of the recording medium, for forming the toner image on the other surface of the recording medium, a fixing unit for fixing the toner images onto the double surfaces of the recording medium, and a control unit for controlling the first and second image forming units. The control unit controls, when in one-side printing, the first image forming unit disposed downstream in the carrying direction. A distance between the fixing unit and the first image forming unit is short, and hence the blank space on the recording medium can be minimized.

16 Claims, 10 Drawing Sheets

DOUBLE SIDE PRINTING APPARATUS

BACKGROUND OF THE INVENTION

1. Field of the Invention

The present invention relates generally to a double side printing apparatus for printing on opposite sides of a recording medium and, more particularly, to a double side printing apparatus for making one-side printing feasible.

2. Related Background Art

A printing apparatus has been widely utilized as an output apparatus of a computer. An electrophotographic apparatus capable of printing on an ordinary sheet of paper has been utilized as the printing apparatus. In response to a demand for saving natural resources in recent years, a double side printing apparatus for printing on opposite sides of the sheet has been required. Then, an apparatus provided with both a mechanism for printing on the right side of the recording medium and a mechanism for a printing mechanism for printing on the reverse side of the recording medium, is required for increasing a printing speed.

FIG. 12 is an explanatory view showing the prior art.

The perfecting (double side printing) apparatus includes a printing unit 9*b* for printing on the right side of a sheet of recording paper P(which is hereafter simply referred to as the sheet P), and a printing unit 9*a* for printing on the reverse side of the sheet P. The sheet P is classified as a continuous sheet perforated per page. The printing unit 9*a* for printing on the reverse side has a photosensitive drum 90. The photosensitive drum 90 is charged by an unillustrated pre-charger and thereafter exposed to a light image by an exposing unit (not shown). An electrostatic latent image corresponding to the light image is formed on the photosensitive drum 90. The latent image on the photosensitive drum 90 is developed by an unillustrated developing unit. Then, the developed image on the photosensitive drum 90 is transferred onto the sheet P by a transferring unit 91. Thus, the image is printed on the reverse side of the sheet P.

The printing on the right side of the sheet P is likewise performed. To be specific, the printing unit 9*b* for printing on the right side has a photosensitive drum 92. The photosensitive drum 92 is charged by an unillustrated pre-charger and thereafter exposed to a light image by the exposing unit (not shown). An electrostatic latent image corresponding to the light image is formed on the photosensitive drum 92. The latent image on the photosensitive drum 92 is developed by the unillustrated developing unit. Subsequently, the developed image on the photosensitive drum 92 is transferred onto the sheet P by a transferring unit 93. Thus, the image is printed on the right side of the sheet P.

Toner images are fixed onto both sides of the sheet P by a fixing unit 94. The thus constructed perfecting apparatus for printing on the continuous sheet is disclosed in Japanese Patent Application Laid-Open Publication Nos.7-77851 and 8-211664.

There arise, however, the following problems inherent in the prior art perfecting apparatus.

With a diversification of printing modes, there is a mode for printing on only one side of the recording sheet. With this demand, the perfecting apparatus is required to print on only one side of the recording sheet. In this case, a problem is that the prior art perfecting apparatus does not have a one-side printing mode, and hence the one-side printing is difficult to perform.

SUMMARY OF THE INVENTION

It is a primary object of the present invention to provide a perfecting apparatus capable of executing one-side printing in addition to double-side printing.

It is another object of the present invention to provide a perfecting apparatus capable of minimizing a blank space on a recording medium even when effecting the one-side printing.

It is a further object of the present invention to provide a perfecting apparatus constructed to minimize a back-feed quantity when in the one-side printing mode.

To accomplish the above objects, according to a first aspect of the present invention, a perfecting apparatus comprises a feeding unit for feeding a recording medium, a first image-forming unit disposed downstream in a feeding direction of the recording medium for forming a toner image on one surface of the recording medium, a second image-forming unit disposed upstream in the feeding direction of the recording medium from the first image forming unit for forming the toner image on the other surface of the recording medium, a fixing unit for fixing the toner images on the double surfaces of the recording medium, and a control unit for controlling the first and second image forming units when in a double-side printing mode. Then, the control unit, when in the one-side printing mode, controls the first image forming unit disposed downstream in the feeding direction in order for the first image-forming unit to form the toner image on one surface of the recording medium.

According to the present invention, first, one-side printing is conducted by use of one of the two image-forming units. Second, in the perfecting apparatus, the toner image on the image-forming unit is fixed thereto by the fixing unit. Therefore, a printing last page is at the fixing unit. The recording medium positioned between this fixing unit and the image-forming unit comes to an unused space when starting the print. Hence, it is required that this unused space be minimized. For this requirement, when performing one-side printing, the printing is executed by using the first image-forming unit disposed downstream in the feeding direction.

The first image-forming unit is more proximal to the fixing unit than the second image-forming unit, and hence a distance between the fixing unit and the first image-forming unit is short. With this contrivance, it is feasible to decrease the number of pages of the recording medium between the fixing unit and the image-forming unit when in the one-side printing mode. The unused blank space can be thereby minimized.

Further, at the start of the one-side printing, when performing the control of positioning the printing start page of the recording medium at the first image-forming unit by feeding the recording medium back thereto, this back-feed quantity can be reduced. Consequently, the time until the one-side printing mode is started can be reduced.

According to a second aspect of the present invention, the control unit, when in the one-side printing mode controls the first image forming unit after feeding a printing start page of the recording medium back to the first image forming unit. Since the printing start page is fed back, even when performing the one-side printing, the pages turning out to be the blank spaces can be minimized.

According to a third aspect of the present invention, a perfecting apparatus may further comprise a guide roller, provided between the first image-forming unit and the fixing unit, for giving a tension to the recording medium by its coming into contact with the other surface of the recording medium. Because of the guide roller being provided between the first image forming unit and the fixing unit, the tension can be imparted to the recording medium, thereby preventing a jam in feeding.

According to a fourth aspect of the present invention, the control unit, when in the double-side printing mode, controls the first and second image forming units after feeding the printing start page of the recording medium back to the second image forming unit. When in the double-side printing mode, the printing start page of the recording medium is fed back to the second image forming unit, and therefore the pages turning out to be the blank spaces can be minimized also when in the double-side printing mode.

According to a fifth aspect of the present invention, the control unit, when in the one-side printing mode, controls the second image forming unit so as to stop an operation of the second image forming unit. Under this control, the image forming unit unused is not allowed to operate, whereby a longer life-span of the apparatus can be attained.

According to a sixth aspect of the present invention, the fixing unit is constructed of a first fixing unit for fixing the image on one surface of the recording medium, and a second fixing unit provided in a position spaced a distance L4 away from the first fixing unit in order to fix the image on the other surface of the recording medium, and the distance L4 is set equal to, or smaller than, a distance L3 between an image forming position of the first image-forming unit and an image forming position of the second image-forming unit.

With this construction, when switched over to the double-side printing mode from the one-side printing mode, or when the double-side printing mode resumes, a back-feed quantity can be reduced, and a printing speed can be increased.

According to a seventh aspect of the present invention, the first image forming unit is composed of an image bearing body taking an endless configuration, an image forming unit for forming a latent image on the image bearing body, a developing unit for developing the latent image on the image bearing body into a toner image, and a transferring unit for transferring, onto the other surface of the recording medium, the developed image on the image bearing body.

According to an eighth aspect of the present invention, the first image forming unit includes a retract unit for retracting the transferring unit from the image bearing body, and the second image forming unit includes a retract unit for retracting the transferring unit from the image bearing body, and the control unit, when feeding back the recording medium, retracts the transferring unit of the first image forming unit and the transferring unit of the second image forming unit.

The transferring unit is retracted, and hence the back-feed of the recording medium can be smoothly executed. According to a ninth aspect of the present invention, the control unit, when in the one-side printing mode, retracts the transferring unit of the second image forming unit. The transferring unit of the image forming unit unused when in the one-side printing mode, is retracted, and therefore no extra load is exerted upon the recording medium. Hence, this enables the ne-side printing to be done smoothly.

Other features and advantages of the present invention ill become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which.

DESCRIPTION OF THE PREFERRED EMBODIMENTS

Figure 1:
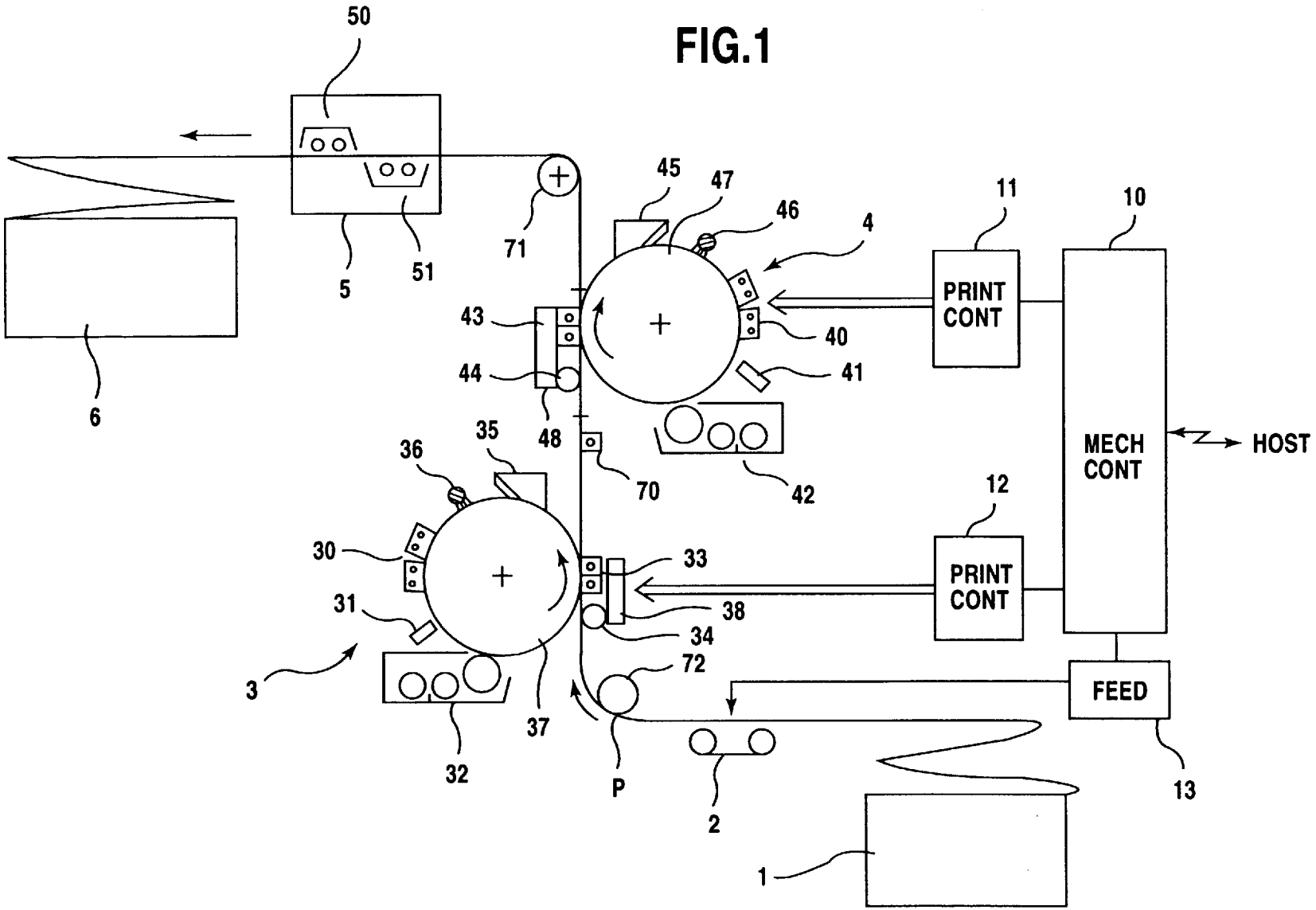
FIG. 1 is a view showing a construction of a perfecting apparatus in one embodiment of the present invention.
Figure 2:
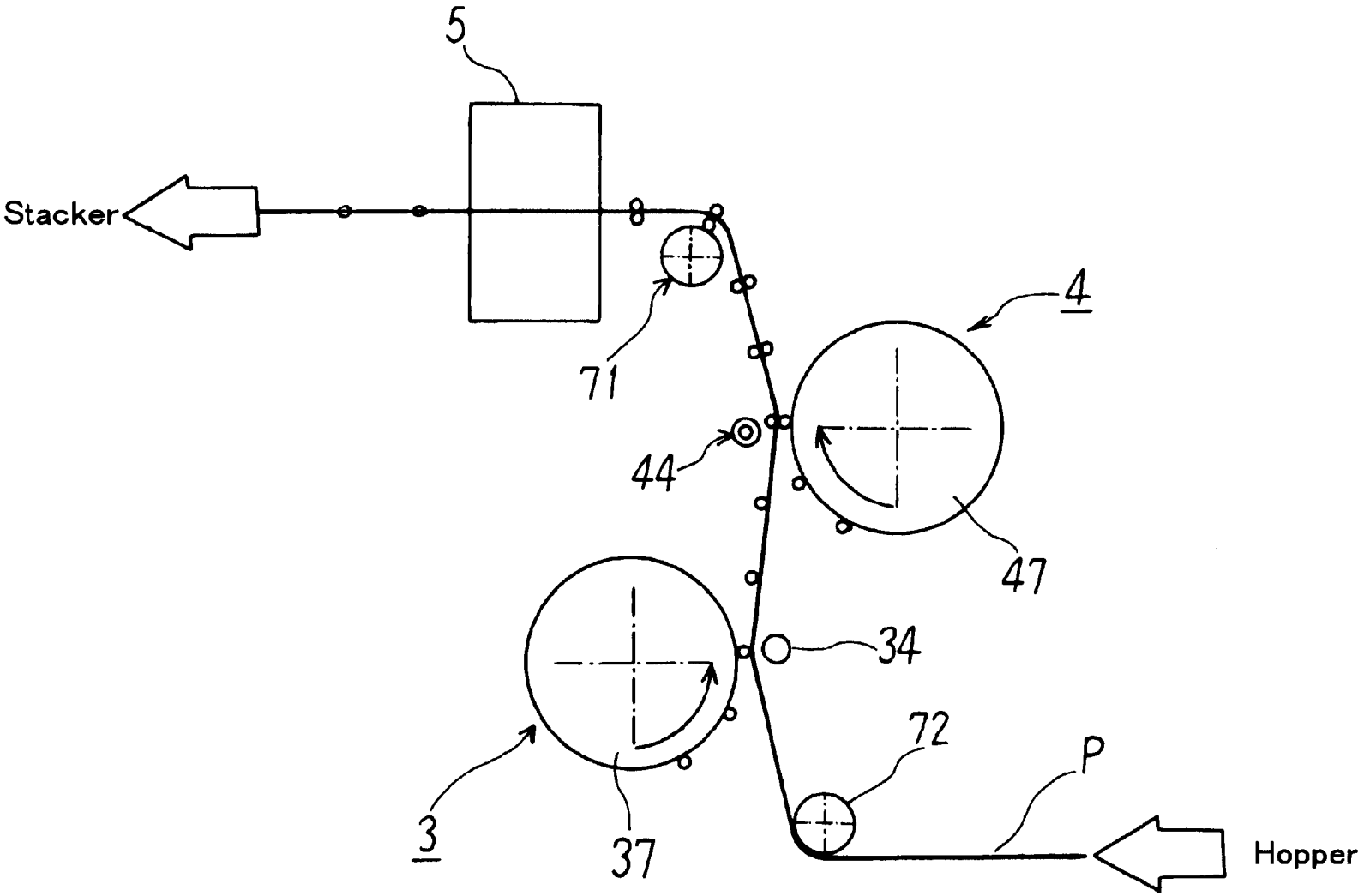
FIG. 2 is an explanatory view showing an operation when in a double-side printing mode in the construction in FIG. 1.
Figure 3:
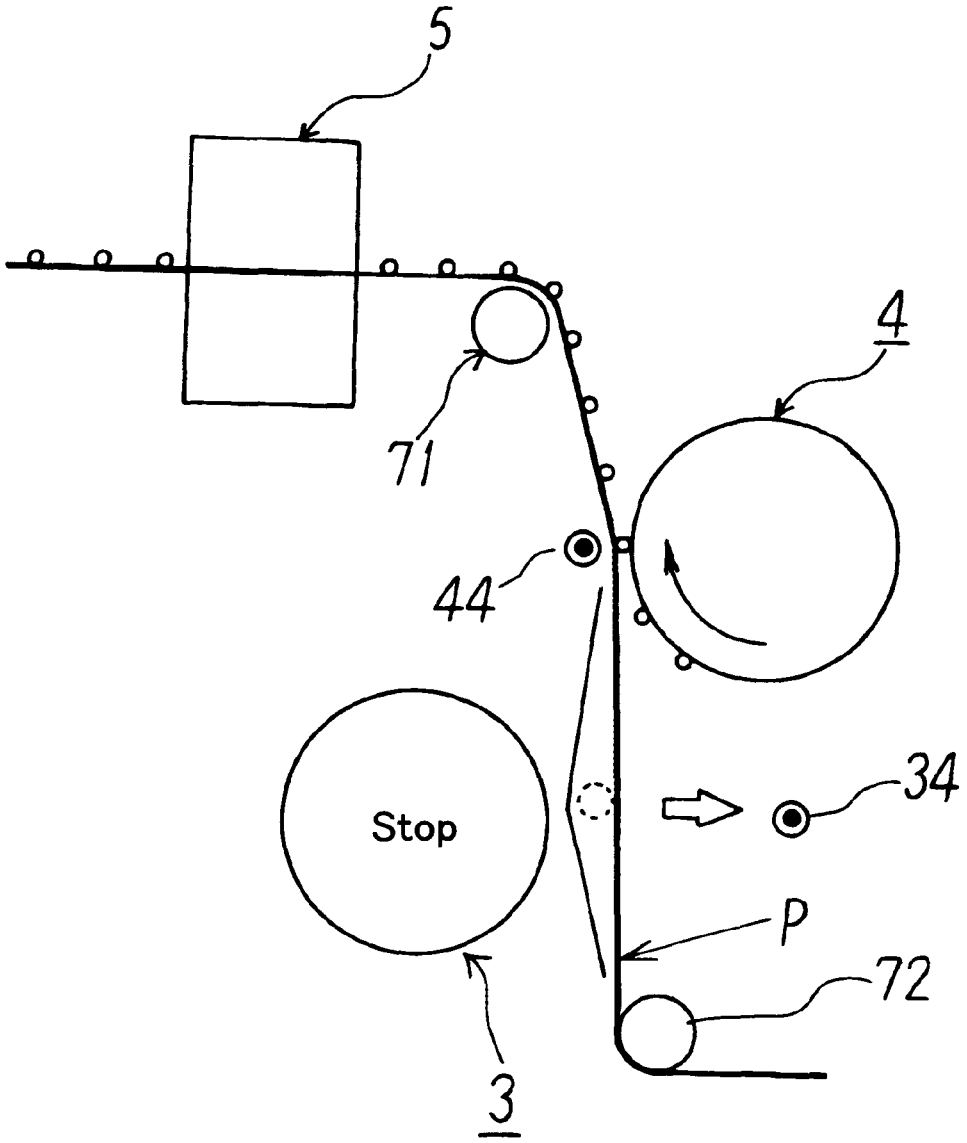
FIG. 3 is an explanatory view showing an operation when in a one-side printing mode in the construction in FIG. 1.

FIG. 1 is a view showing a construction of a perfecting apparatus in one embodiment of the present invention. FIG. 2 is an explanatory diagram showing how a double-side printing operation in FIG. 1 is carried out. FIG. 3 is an explanatory diagram showing how a one-side printing operation in FIG. 1 is executed.

FIG. 1 illustrates a perfecting apparatus for effecting prints on opposite sides of a continuous sheet of paper having feed perforations. A hopper 1 is stacked with unprinted continuous sheets of paper P. The continuous sheet P is perforated per page. A sheet carrier tractor 2 engages with the feed perforations of the continuous sheet P and thus feeds the continuous sheet P in an arrow direction around guide roller 72. A reverse side printing mechanism (a second image-forming unit) 3 is constructed of an electrophotographic printing mechanism, and effects printing on the reverse side of the continuous sheet P.

This reverse side printing mechanism 3 includes a photosensitive drum 37 defining an endless surface for bearing a latent image, a charging unit 30 for charging the photosensitive drum 37 with electricity, and an LED head 31 for having the photosensitive drum 37 exposed to a one-line light image. This LED head 31 is composed of an LED array where LEDs (light emitting diodes), the number of which is set corresponds to one line, are arrayed.

A developing unit 32 develops the latent image on the photosensitive drum 37. A transfer charging unit 33 transfers, onto the continuous sheet P, the developed image on the photosensitive drum 37. A transfer guide roller 34 presses the continuous sheet P against the photosensitive drum 37. A retract mechanism 38 for retracting the transfer guide roller 34 when in a non-transfer process and thus prevents the continuous sheet P from coming into contact with the photosensitive drum 37. A cleaner 35 collects residual toners on the photosensitive drum 37. A de-electrifying lamp 36 removes a residual potential out of the photosensitive drum 37.

A right side printing mechanism (a first image-forming unit) 4 is also composed of an electrophotographic printing mechanism, and implements the printing on the right side of the continuous sheet P. The right side printing mechanism 4 is disposed downstream of the reverse side printing mechanism 3 in a sheet feeding direction.

This right side printing mechanism 4 is similarly constructed of a photosensitive drum 47 defining an endless surface for bearing a latent image, a charging unit 40 for charging the photosensitive drum 47 with electricity, and an LED head 41 for having the photosensitive drum 47 exposed to a one-line light image. This LED head 41 is composed of an LED array where LEDs (light emitting diodes), the number of which is set corresponds to one line, are arrayed.

A developing unit 42 develops the latent image on the photosensitive drum 47. A transfer charging unit 43 transfers, onto the continuous sheet P, the developed image on the photosensitive drum 47. A transfer guide roller 44 presses the continuous sheet P against the photosensitive drum 47. A retract mechanism 48 for retreating the transfer guide roller 44 when in the non-transfer process and thus prevents the continuous sheet P from coming into contact with the photosensitive drum 47. A cleaner 45 collects residual toners on the photosensitive drum 47. A de-electrifying lamp 46 removes a residual potential out of the photosensitive drum 47.

A neutralization charging unit 70 is provided between the reverse side printing mechanism 3 and the right side printing mechanism 4, and neutralizes an electric potential on the right side of the continuous sheet P assuming the electric potential through the reverse side printing mechanism 3. The transferring operation can be thereby performed with a stability in the right side printing mechanism 4.

A guide roller 71 diverts in a horizontal direction the continuous sheet P carried in the vertical direction, and thus guides the sheet P to the fixing unit 5. The fixing unit 5 is constructed of a pair of flash fixing units 50, 51, and fixes the toner images on the two sides of the continuous sheet P. A stacker 6 is stacked with the printed continuous sheets P.

A mechanism control unit 10 controls print control units 11, 12 in accordance with a print indication and print data given from a host computer. The first print control unit 11 controls the right side printing mechanism 4 in accordance with the indication from the mechanism control unit 10. The second print control unit 12 controls the reverse side printing mechanism 3 in accordance with the indication from the mechanism control unit 10. A paper feed control unit 13 controls the feed tractor 2 in accordance with an indication from the mechanism control unit 10.

In this perfecting apparatus, during the double-side printing process, the reverse side printing mechanism 3 starts printing in advance of the right side printing mechanism 4. Further, the carrier path is set in the vertical direction, and the reverse- and right-side printing mechanisms 3, 4 are disposed with the carrier path interposed therebetween. With this configuration, the perfecting apparatus can be downsized.

Figure 10:
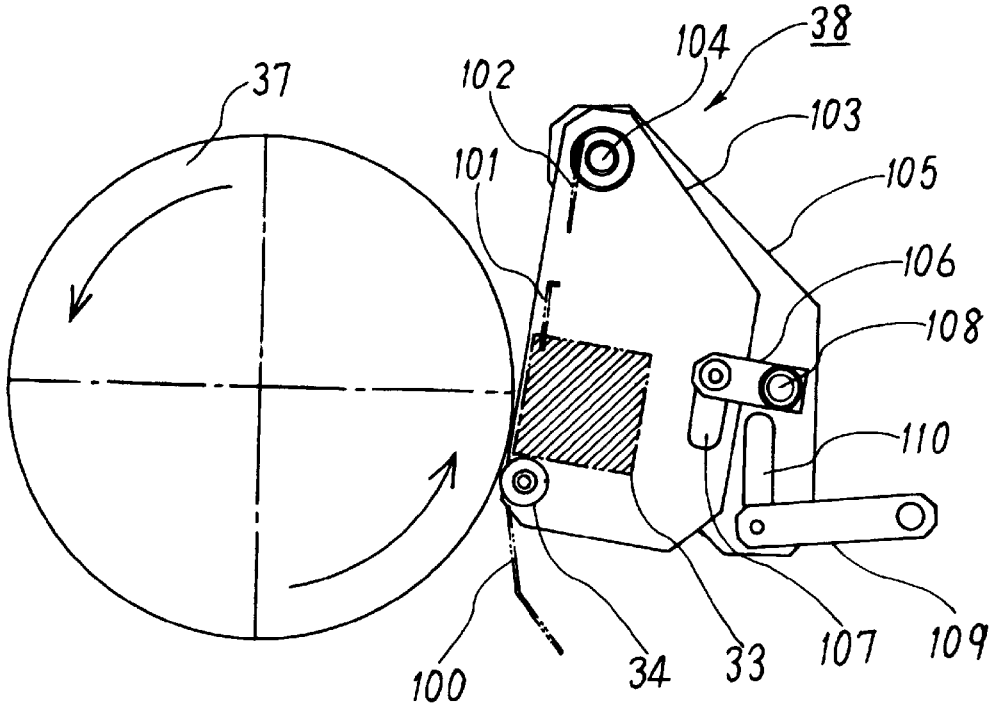
FIG. 10 is a view illustrating a construction of a retract mechanism in FIG. 1.
Figure 11:
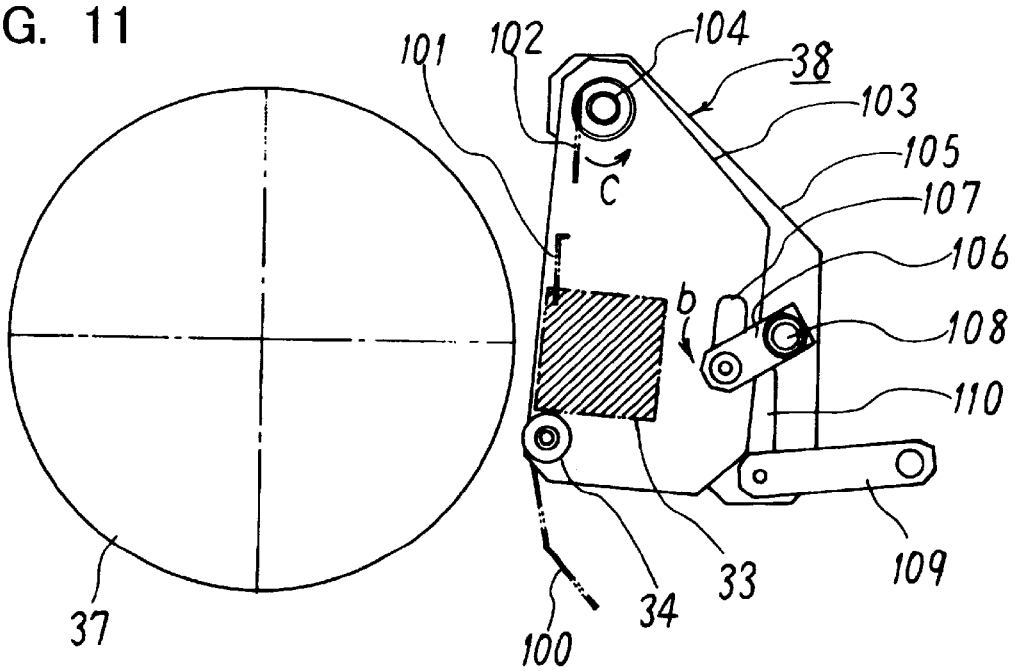
FIG. 11 is an explanatory view showing the retract mechanism in FIG. 10.
Figure 12:
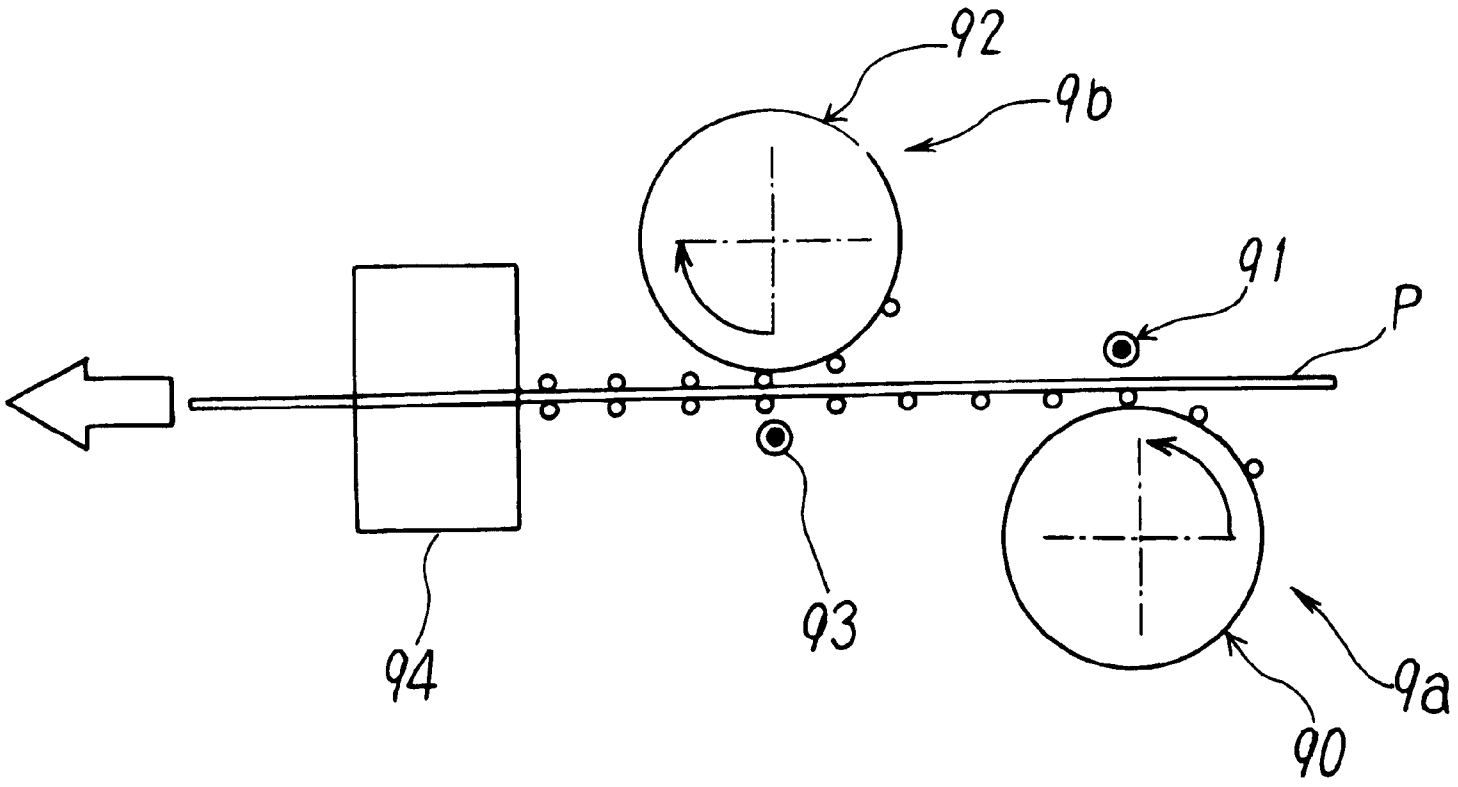
PRIOR ART FIG. 12
FIG. 12 is an explanatory view showing the prior art.

Next, the retract mechanisms 38, 48 will be explained. FIG. 10 is a view showing a construction of the retract mechanism in FIG. 1. FIG. 11 is an explanatory view showing the retract mechanism FIG. 10.

As illustrated in FIG. 10, a transfer frame 103 is provided with a transfer guide roller 34, a transfer charging unit 33, and sheet guides 100, 101, 102. The transfer frame 103 is so fitted to a jam treatment frame 105 as to be pivotable about a pivot shaft 104. The transfer frame 103 is formed with a slide groove 107 extending approximately in parallel to the transfer charging unit 33. A retract arm 106 is fitted into the slide groove 107. The retract arm 106 is pivotable about a shaft 108. The shaft 108 is rotated by an unillustrated stepping motor.

The jam treatment frame 105 is pivoted about the shaft 104. The jam treatment frame 105 is formed with a slide groove 110. A drive arm 109 is fitted into the slide groove 110.

As shown in FIG. 10, when the retract arm 106 is positioned at an upper edge of the slide groove 107, the transfer frame 103 is in a transfer position. Namely, the transfer guide roller 34 is in a position for pressing the sheet against the photosensitive drum 37, and the transfer charging unit 33 has a close proximity to the photosensitive drum 37.

As illustrated in FIG. 11, the retract arm 106 is pivoted in an arrow direction b in FIG. 11 by the stepping motor, and thereupon the transfer frame 103 pivots about the shaft 104 in an arrow direction c in FIG. 11. Consequently, the transfer frame retracts to a retracted position. That is, the transfer guide roller 34 is in a position away from the photosensitive drum 37, and the transfer charging unit 33 is also in a position away from the photosensitive drum 37.

In this retracted position, the sheet is not pressed against the photosensitive drum 37 and is in a non-contact state with the photosensitive drum 37. Therefore, the sheet can be carried smoothly when in the one-side printing mode. Further, the retract mechanism, the transfer frame 103 being provided with the transfer guide roller 34, the transfer charging unit 33 and the sheet guides 100–102, operates and thus retracts this transfer frame 103. It is therefore feasible to retract all the components which act as a load upon the sheet. Besides, this retract mechanism can be produced from a simple construction.

Note that the retract mechanism 48 of the right side printing mechanism 4 has the same construction, of which the explanation is therefore omitted.

Next, the double- and one-side printing operations are described. As shown in FIG. 2, when in the double-side printing mode, in the reverse side printing mode mechanism 3, the retract mechanism 38 makes the transfer roller 34 press the continuous sheet P against the photosensitive drum 37. Further, in the right side printing mode mechanism 4, the retreat mechanism 48 makes the transfer roller 44 press the continuous sheet P against the photosensitive drum 47.

The two printing mechanisms 3, 4 operate to form the toner images on the double sides of the continuous sheet P. Then, the direction of the continuous sheet P is diverted by the guide roller 71, and thereafter the toner images on the continuous sheet P are fixed thereonto by the fixing unit 5.

Moreover, as shown in FIG. 3, the one-side printing mode involves the use of the right side printing mechanism 4. In the reverse side printing mechanism 3, the retract mechanism 38 retracts the transfer roller 34 to separate the continuous sheet P from the photosensitive drum 37. Further, in the right side printing mechanism 4, the retract mechanism 48 makes the transfer roller 44 press the continuous sheet P against the photosensitive drum 47.

The toner image is formed on only the right side of the continuous sheet P by operating only the right side printing mechanism 4. Then, the direction of the continuous sheet P is diverted by the guide roller 71, and thereafter the toner image on the continuous sheet P is fixed thereonto by the fixing unit 5.

The right side printing mechanism 4 is closer to the fixing unit 5 than the reverse side printing mechanism 3, and hence a distance between the fixing unit 5 and the printing mechanism 4 which operates can be reduced. It is therefore possible to minimize a futile space between the fixing unit 5 and the printing mechanism 4. Further, when the continuous sheet P is fed back to the right side printing mechanism 4 at a start of the one-side printing process a back-feed quantity can be decreased. A time required for the back-feed at the start of the one-side printing mode can be therefore shortened.

Moreover, when in the one-side printing mode, the reverse side printing mechanism 3 halts. Accordingly, the reverse side printing mechanism 3 can be prevented from operating for no reason. Further, since the transfer roller 34 of the reverse side printing mechanism 3 remains retracted, the continuous sheet P can be prevented from coming into contact with the photosensitive drum 37 of the reverse side printing mechanism 3. Hence, the continuous sheet P can be prevented from being stained when in the one-side printing mode.

Moreover, the guide roller 71 carries the continuous sheet P and prevents a flexure of the continuous sheet P. The guide roller 71 is provided on the reverse side of the continuous sheet P and is therefore not brought into contact with the right side of the continuous sheet P. Hence, the guide roller 71 can be prevented from disturbing the formation of the image toner on the right side of the continuous sheet P when in the one-side printing. That is, the continuous sheet P can be carried without disturbing the formation of the toner image when in the one-side printing mode.

Figure 4:
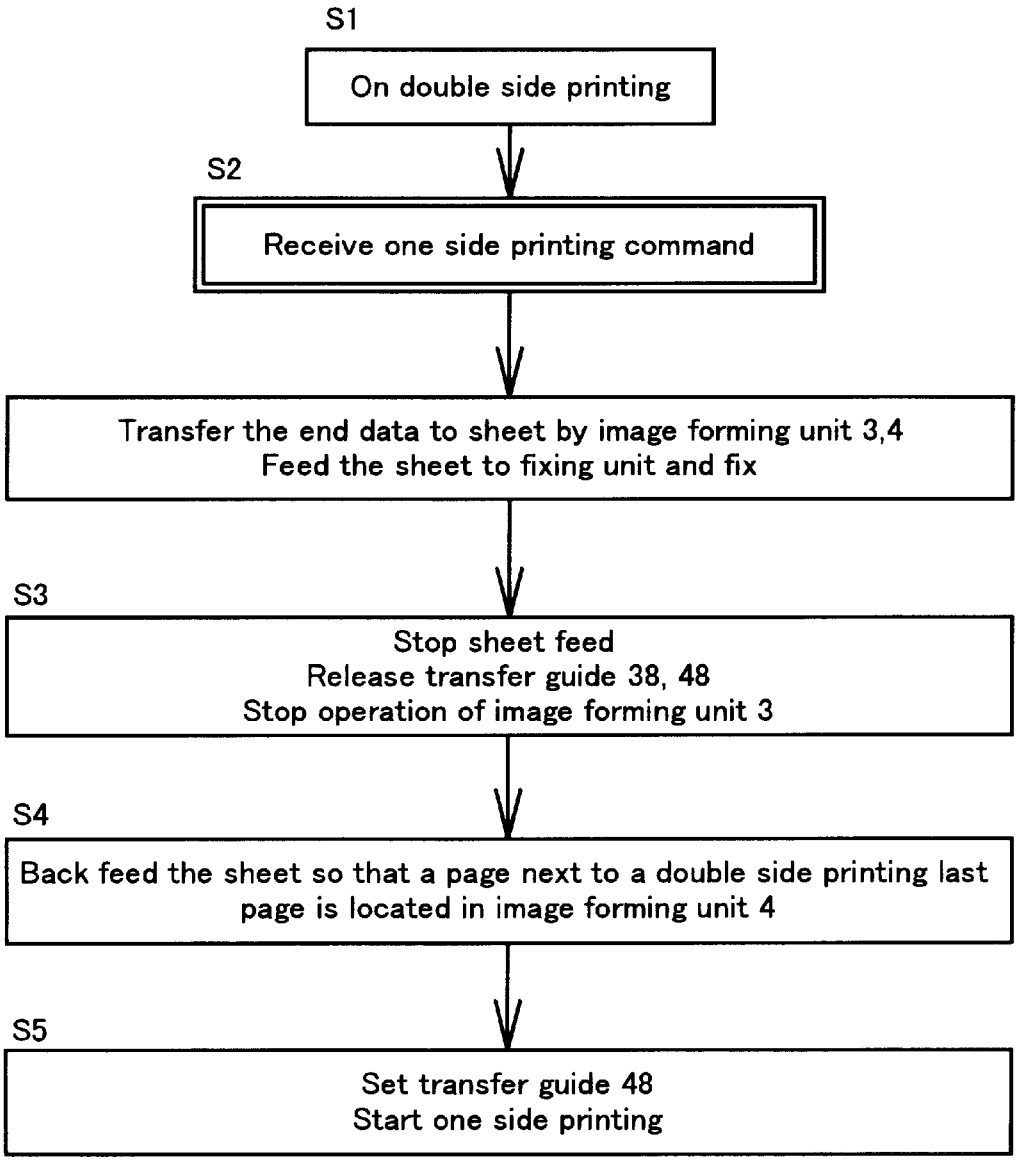
FIG. 4 is a flowchart showing a one-side printing mode switching process in the construction in FIG. 1.
Figure 5:
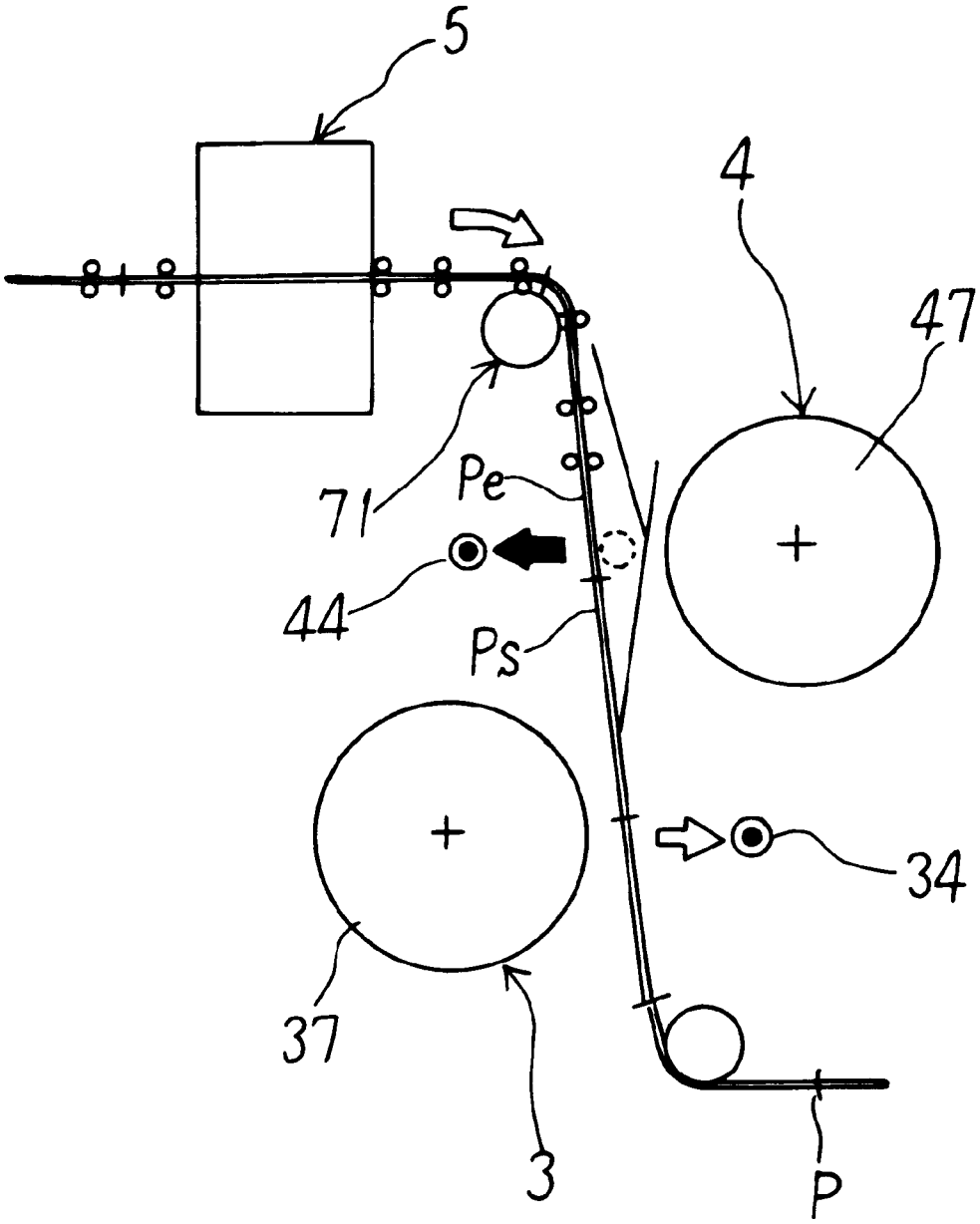
FIG. 5 is an explanatory view showing a back-feed operation when in the one-side printing mode in FIG. 4.

FIG. 4 is a flowchart of a one-side printing switching process based on the construction in FIG. 1. FIG. 5 is an explanatory diagram showing a back-feed operation when in the one-side printing in FIG. 4.

(S1) In response to an indication from the host computer, the mechanism control unit 10 controls the two printing control units 11, 12 to operate both the right side printing mechanism 4 and the reverse side printing mechanism 3. The printings on the two sides of the continuous sheet P are thereby executed.

(S2) The mechanism control unit 10, upon receiving a one-side printing command subsequent to the double-side printing data on the last page from the host computer, operates the right- and reverse-side printing mechanisms 3, 4 to print (transfer) the last-page double-side printing data on the continuous sheet P, and, for fixing the toner images, the printing last page of the continuous sheet P is carried to the fixing unit 5. The toner images printed on the two sides thereof are thereby fixed thereonto.

(S3) The mechanism control unit 10, upon the fixation onto the two sides of the printing last page, stops carrying the sheet. Then, as shown in FIG. 5, the mechanism control unit 10 operates the retract mechanism 38 of the reverse side printing mechanism 3, thereby retracting the transfer roller 34 from the photosensitive drum 37. Further, the mechanism control unit 10 operates the retract mechanism 48 of the right side printing mechanism 4, thereby retracting the transfer roller 44 from the photosensitive drum 47. Then, the mechanism control unit 10 stops the operation of the reverse side printing mechanism 3.

(S4) As shown in FIG. 5, the mechanism control unit 10 controls the sheet feed control unit 13 to feed back the continuous sheet P so that a page (a one-side printing start page) Ps next to a double-side printing last page Pe of the continuous sheet P is located in a transfer position (a writing start position) of the right side printing mechanism 4.

(S5) Next, the mechanism control unit 10 operates the retract mechanism 48 of the right side printing mechanism 4 to press the transfer roller 44 against the photosensitive drum 47. Then, the mechanism control unit 10 controls the right side printing mechanism 4 through the print control unit 11, thus effecting the one-side printing.

After fixing the toner images printed on the double sides in this way, the continuous sheet P is fed back so that the page (the one-side printing start page) Ps next to the double-side printing last page Pe is located in the transfer position (the writing start position) of the right side printing mechanism 4. It is therefore possible to eliminate a blank space on the sheet even in the case of the continuous sheet.

Further, the right side printing mechanism 4 disposed downstream in the carrying direction performs the one-side printing, and the distance between the fixing unit 5 and the right side printing mechanism 4 can be reduced. Consequently, a small back-feed quantity may suffice. Accordingly, a back-feed time when starting the one-side printing can be decreased. This makes it feasible to prevent the printing speed from decreasing even when switched over to the one-side printing from the double-side printing.

Figure 6:
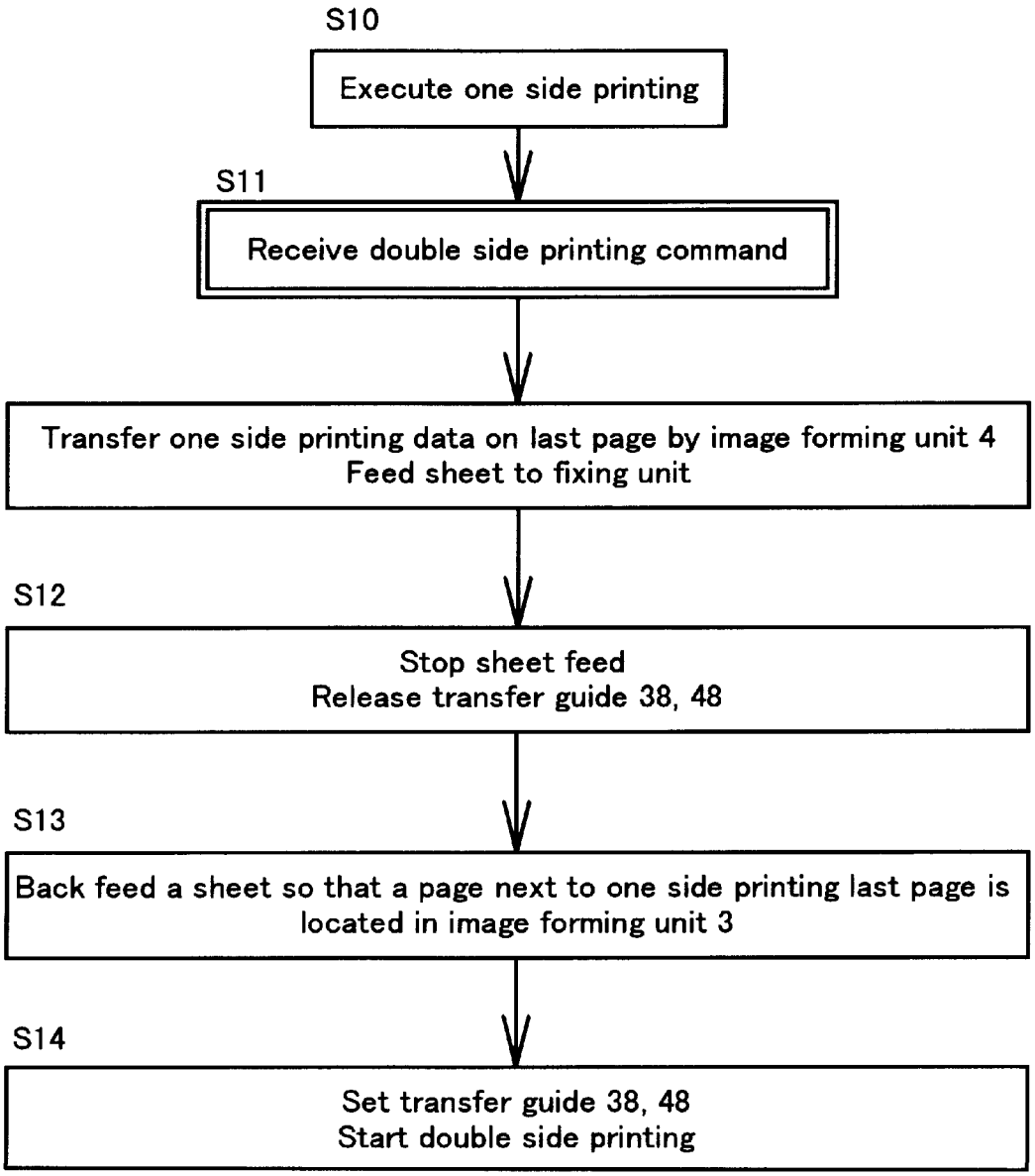
FIG. 6 is a flowchart showing a double-side printing mode switching process in the construction in FIG. 1.
Figure 7:
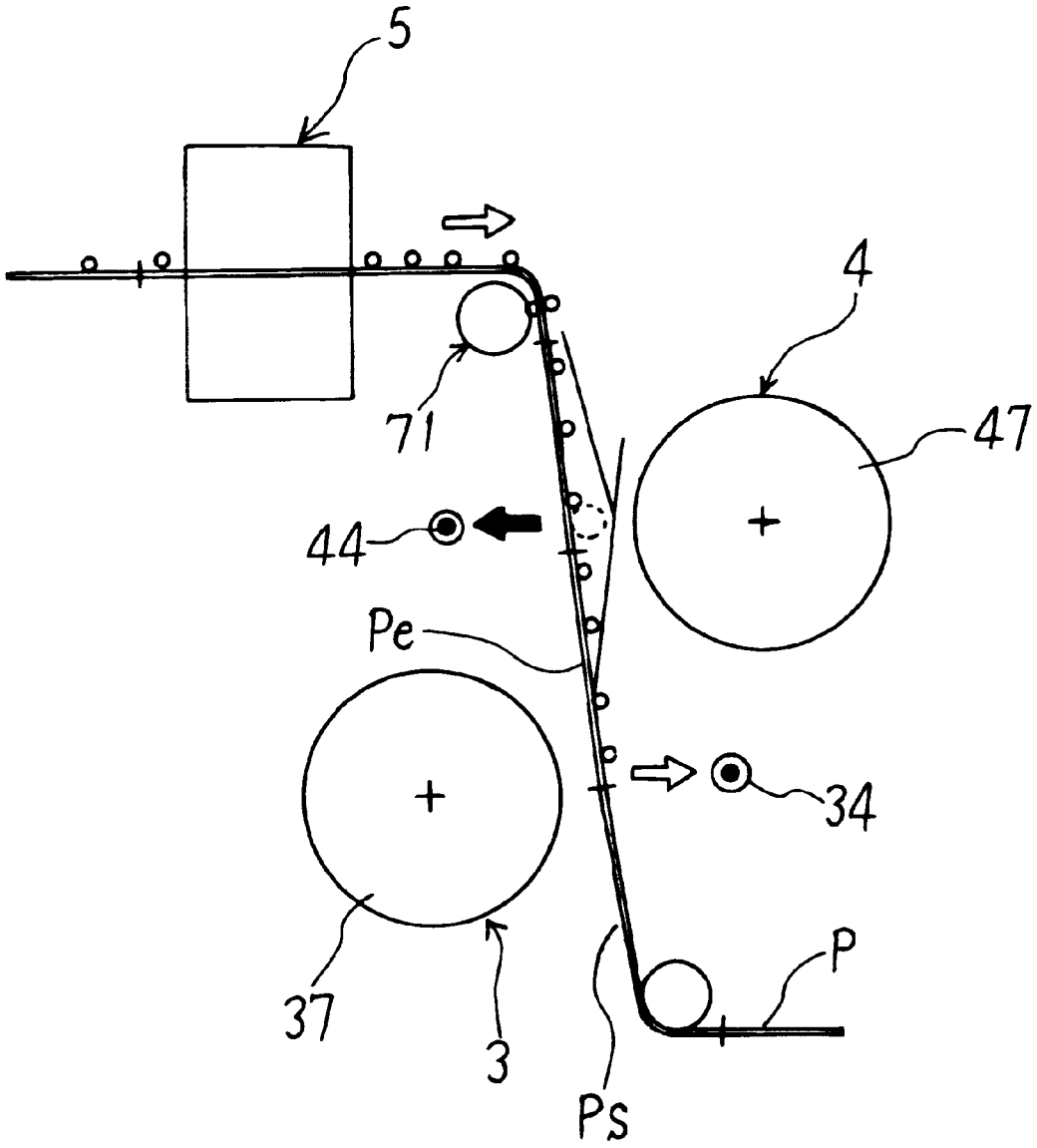
FIG. 7 is an explanatory view showing the back-feed operation when in the double-side printing mode in FIG. 6.

FIG. 6 is a flowchart showing a double-side printing switching process based on the construction in FIG. 1. FIG. 7 is an explanatory diagram showing a back-feed operation when in the double-side printing in FIG. 6.

(S10) In response to an indication from the host computer, the mechanism control unit 10 controls the printing control unit 11 to operate the right side printing mechanism 4. The printing on the one side of the continuous sheet P is thereby executed.

(S11) The mechanism control unit 10, upon receiving a double-side printing command subsequent to the one-side printing data on the last page from the host computer, operates the right side printing mechanism 4 to print (transfer) the last-page one-side printing data on the continuous sheet P, and thereafter, for fixing this toner image, the printing last page of the continuous sheet P is carried to the fixing unit 5. The toner image printed on the one side thereof is thereby fixed thereonto.

(S12) The mechanism control unit 10, upon the fixation onto the one side of the printing last page, stops carrying the sheet. Then, as shown in FIG. 7, the mechanism control unit 10 operates the retract mechanism 38 of the reverse side printing mechanism 3, thereby retracting the transfer roller 34 from the photosensitive drum 37. Further, the mechanism control unit 10 operates the retract mechanism 48 of the right side printing mechanism 4, thereby retracting the transfer roller 44 from the photosensitive drum 47.

(S13) As shown in FIG. 7, the mechanism control unit 10 controls the sheet feed control unit 13 to feed back the continuous sheet P so that a page (the double-side printing start page) Ps next to the one-side printing last page Pe of the continuous sheet P is located in a transfer position (a writing start position) of the reverse side printing mechanism 3.

(S14) Next, the mechanism control unit 10 operates the retract mechanism 48 of the right side printing mechanism 4 to press the transfer roller 44 against the photosensitive drum 47. Then, the mechanism control unit 10 operates the reverse side printing mechanism 3 to press the transfer roller 34 against the photosensitive drum 37. Then, the mechanism control unit 10 controls the right- and reverse-side printing mechanisms 4, 3 through the print control units 11, 12, thus effecting the double-side printing.

After fixing the toner image printed on the one side in this way, the continuous sheet P is fed back so that the page (the double-side printing start page) Ps next to the one-side printing last page Pe is located in the transfer position (the writing start position) of the reverse side printing mechanism 3. It is therefore possible to eliminate a blank space on the sheet even in the case of the continuous sheet.

Figure 8:
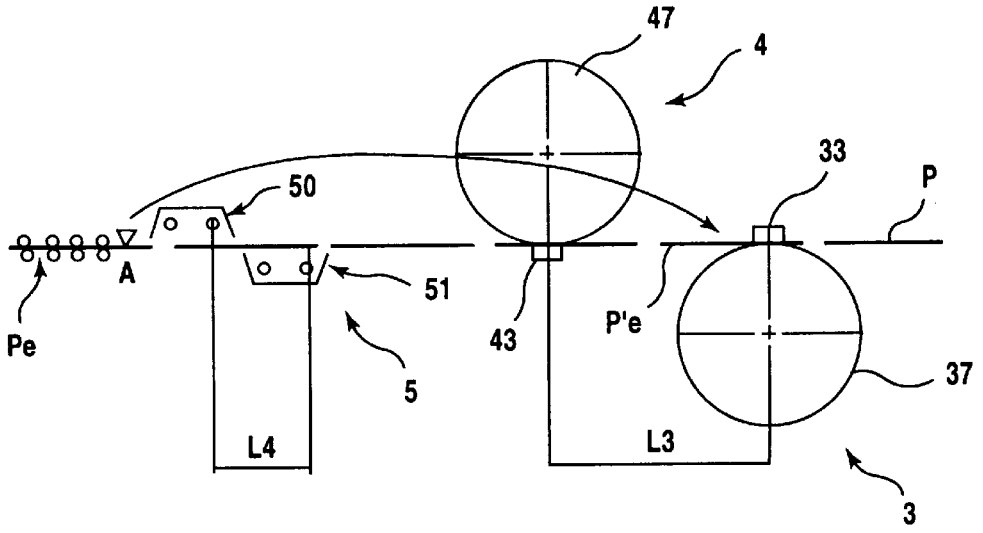
FIG. 8 is an explanatory view showing the back-feed operation in the construction in FIG. 1.
Figure 9:
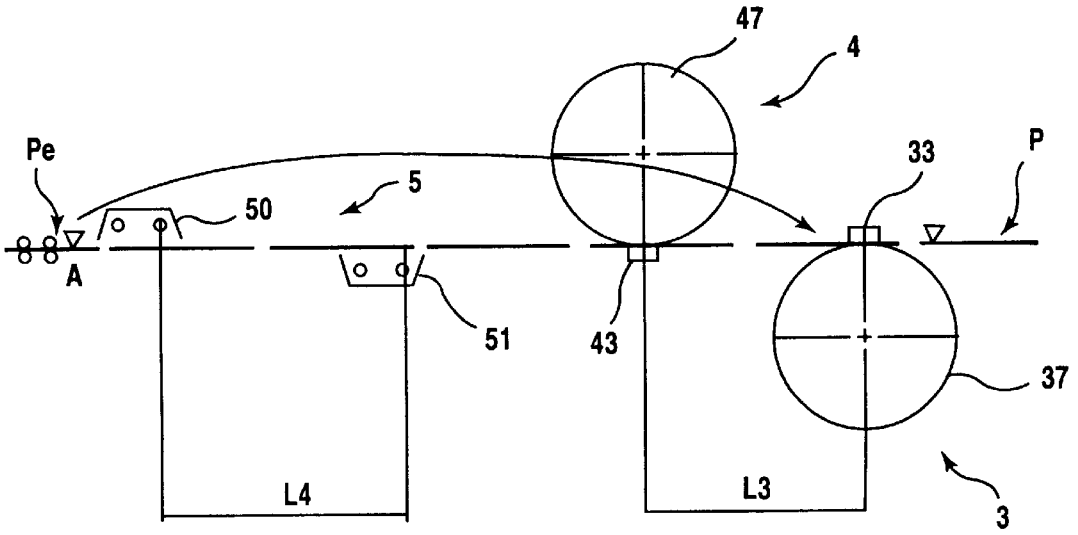
FIG. 9 is an explanatory view showing a comparative example of the back-feed operation in FIG. 8.

FIG. 8 is an explanatory view showing a back-feed operation when in the double-side printing mode shown in FIG. 7. FIG. 9 is an explanatory view, showing a comparative example of the back-feed operation, for explaining the operation in FIG. 8.

As shown in FIG. 8, the fixing unit 5 is composed of a pair of flash fixing units 50, 51. It is difficult in terms of construction to provide these flash fixing units 50, 51 in the same positions. The flash fixing units 50, 51 are therefore disposed in positions spaced a distance L4 away from each other.

Herein, let L3 be a distance between a transfer position (a position of the transfer charging unit 43) of the right side printing mechanism 4 and a transfer position (a position of the transfer charging unit 33) of the reverse side printing mechanism 3. This distance L3 is fixed based on dimensions of the printing mechanisms 3, 4.

FIG. 8 shows the case in which the distance L4 between the fixing units is set smaller than the distance L3 between the transfer positions. FIG. 9 shows the comparative example where the distance L4 between the fixing units is set larger than he distance L3 between the transfer positions.

As shown in FIG. 8, when switched over from the one-side printing to the double-side printing, or when the double printing resumes, the printing last page Pe with the fixation done is fed back to the transfer position of the reverse side printing mechanism 3. At this time, a back-feed quantity in the case of FIG. 8 is smaller by one page than in the case of FIG. 9.

Therefore, when L4≦L3, the back-feed quantity can be reduced. A time until the printing is started can be thereby decreased.

In addition to the embodiment discussed above, the present invention may be modified as follows.

(1) The electrophotographic mechanism has been exemplified as the printing mechanism, however, other printing mechanisms for forming the toner images can be also applied.

(2) The flash fixing units has been exemplified as the fixing unit, however, other fixing units such as a thermal roller fixing unit, etc., can be used.

The present invention has been described so far by way of the embodiments but may be modified in a variety of forms within the scope of the gist of the present invention, and those modifications are not excluded from the range of the present invention.

As discussed above, the present invention exhibits the effects which follow.

(1) When executing a one-side printing, as the first image-forming unit disposed downstream in the carrying direction is used for this printing, it is feasible to decrease the number or pages of the recording medium between the fixing unit and the image-forming unit when in the one-side printing mode. The unused blank space can be there by minimized.

(2) Further, at the start of the one-side printing process, when executing the control of feeding back the recording medium and thus setting the position of the start page of the recording medium at the first image-forming unit, this back-feed quantity can be decreased. Hence, it is feasible to reduce the time until the one-side printing is started.

What is claimed is:

1. A double-side printing apparatus for executing prints on opposite surfaces of a continuous recording medium, comprising:

a first image forming unit, disposed downstream in a feeding direction of said recording medium from a feeding unit, for forming a toner image on one surface of said recording medium;

a second image forming unit, disposed upstream in the feeding direction of said recording medium from said first image forming unit, for forming a toner image on the other surface of said recording medium;

said feeding unit being operative for feeding said recording medium successively and in alternate directions between said first image forming unit and said second image forming unit, a fixing unit operative to fix the toner images selectively on one or both of the surfaces of said recording medium;

a first transferring unit for transferring the toner image from said first image forming unit onto the one surface of said recording medium and a second transferring unit for transferring the toner image from said second image forming unit onto the other surface of said recording medium, wherein said first and second image forming units each include a retract unit for selectively retracting the associated transferring unit from operative engagement with the respective image forming units, a control unit for controlling said first and second image forming units for printing selectively in a single-side printing mode and a double-side printing mode, wherein said control unit controls the retract units of said first and second image forming units to enable printing on the respective surfaces of said recording medium in a one-side printing mode or a double-side printing mode.

2. A double-side printing apparatus according to claim 1, wherein said control unit, when in the one-side printing mode, controls said first image-forming unit disposed downstream in the feeding direction in order for said first image forming unit to form the toner image on said one surface of said recording medium after feeding a printing start page of said recording medium back to said first image-forming unit.

3. A double-side printing apparatus according to claim 2, wherein said control unit, when in the double-side printing mode, controls said first and second image forming units after feeding the printing start page of said recording medium back to said second image forming unit.

4. A double-side printing apparatus according to claim 1, further comprising:

a guide roller, provided between said first image forming unit and said fixing unit, for giving a tension to said recording medium by said guide roller coming into contact with the other surface of said recording medium.

5. A double-side printing apparatus according to claim 1, wherein said control unit, when proceeding from a double-side printing mode to the one-side printing mode, controls said second image forming unit so as to stop an operation of said second image forming unit.

6. A double-side printing apparatus according to claim 1, wherein said fixing unit is constructed of a first fixing unit for fixing a toner image onto one surface of said recording medium, and a second fixing unit provided in a position spaced a distance L4 away from said first fixing unit in order to fix a toner image onto the other surface of said recording medium, wherein the distance L4 is set equal to, or smaller than, a distance L3 between an image forming position of said first image forming unit and an image forming position of said second image forming unit.

7. A double-side printing apparatus according to claim 1, wherein said first image forming unit is composed of a first image bearing body having an endless surface, an image-forming unit for forming a first latent image on said first image bearing body, a developing unit for developing the first latent image on said first image bearing body into a toner image, and said first transferring unit for transferring, onto the one surface of said recording medium, the developed image on said first image bearing body.

8. A double-side printing apparatus according to claim 7, wherein said first image forming unit includes a retract unit for retracting said first transferring unit from said first image bearing body, and said second image forming unit includes a second image bearing body having an endless surface, an image forming unit for forming a second latent image on said second image bearing body, a developing unit for developing the second latent image on said second image bearing body into a toner image, and said second transferring unit for transferring, onto the other surface of said recording medium, the developed image on said second image bearing body, a retract unit for retracting said second transferring unit from said second image bearing body, and said control unit, when feeding back said recording medium, retracts said first transferring unit of said first image forming unit and said second transferring unit of said second image forming unit.

9. A double-side printing apparatus according to claim 8, wherein said control unit, when in the one-side printing mode, retracts the second transferring unit of said second image forming unit.

10. A double-side printing apparatus for executing prints on opposite surfaces of a continuous recording medium, comprising:

a first image-forming unit for forming a toner image on one surface of said recording medium;

a second image-forming unit for forming a toner image on the other surface of said recording medium;

a feeding unit for feeding said recording medium successively between said first and second image-forming units; and a control unit for controlling said first and second image-forming units for printing selectively in a single-side printing mode and a double-side printing mode.

11. A double-side printing apparatus according to claim 10, wherein said control unit controls one of said first and second image-forming units so as to perform said single-side printing mode on a successive printing region of said recording medium to a printed region of said recording medium by said double-side printing mode.

12. A double-side printing apparatus according to claim 10, wherein said control unit, when in the single-side printing mode, controls said first image-forming unit so as to perform said single-side printing mode after feeding a printing start page of said recording medium back to said first image-forming unit, and, when in the double-side printing mode, controls said first and second image-forming units so as to perform said double-side printing mode after feeding a printing start page of said recording medium back to said second image-forming unit.

13. A double-side printing apparatus for executing prints on opposite surfaces of a continuous recording medium, comprising:

a first image-forming unit for forming a toner image on one surface of said recording medium;

a second image-forming unit for forming a toner image on the other surface of said recording medium;

a feeding unit for feeding said recording medium successively and in alternate directions;

a first fixing unit for fixing a toner image onto one surface of said recording medium; and a second fixing unit provided in a position spaced a distance L4 away from said fixing unit in order to fix a toner image onto the other surface of said recording medium, wherein the distance L4 is set equal to or smaller than a distance L3 between an image forming position of said first image-forming unit and an image-forming position of said second image forming unit.

14. A printing control method for printing a continuous recording medium, comprising the steps of:

first step of controlling one of a first and a second image-forming unit for forming a toner image on a single surface of said recording medium in a single-side printing mode; and controlling both said first and second image-forming units for forming toner images on double surfaces of said recording medium in a double-side printing mode.

15. A printing control method according to claim 14, wherein said first recited step comprises a step of feeding a printing start page of said recording medium back to said first image-forming unit, and a step of controlling said first image-forming unit after said back feeding, and said second recited step comprises a step of feeding a printing start page of said recording medium back to said second image-forming unit, and a step of controlling said first and second image-forming units.

16. A storage medium for storing program data, said program data comprising:

a first program data for controlling one of first and second image-forming units for forming a toner image on a single surface of a recording medium in a single-side printing mode; and a second program data for controlling both said first and second image-forming units for forming toner images on double surfaces of said recording medium in a double-side printing mode.

* * * * *